United States Patent [19]

Carter et al.

[11] Patent Number: 4,986,408

[45] Date of Patent: Jan. 22, 1991

[54] APPARATUS FOR HANDLING ROD-LIKE ARTICLES

[75] Inventors: David C. M. Carter, Blakelands; Ian Dunckley, High Wycombe; Leonard G. Lait, Bletchley, all of England

[73] Assignee: Molins plc, London, England

[21] Appl. No.: 249,009

[22] Filed: Sep. 26, 1988

Related U.S. Application Data

[62] Division of Ser. No. 721,414, Apr. 9, 1985, Pat. No. 4,795,020.

[30] Foreign Application Priority Data

Apr. 9, 1984 [GB] United Kingdom ..... 8409097

[51] Int. Cl.[5] ..... B65G 37/00

[52] U.S. Cl. ..... 198/368; 198/532; 198/534

[58] Field of Search ..... 198/419.1, 463.4, 347, 198/525, 530, 532, 534, 366, 368, 370; 53/140, 236; 414/403, 404; 131/282, 283; 193/20, 21

[56] References Cited

U.S. PATENT DOCUMENTS

| | | | |
|---|---|---|---|
| 3,024,585 | 3/1962 | Schubert et al. | 53/148 X |
| 3,068,981 | 12/1962 | Stegmeier et al. | 193/20 X |
| 3,565,237 | 2/1971 | Strydom | 131/282 X |
| 3,952,854 | 4/1976 | Selonke et al. | 198/524 X |
| 4,234,283 | 11/1980 | Twyman et al. | 198/532 X |
| 4,507,040 | 3/1985 | Baese et al. | 198/347 X |

FOREIGN PATENT DOCUMENTS

| | | | |
|---|---|---|---|
| 1923500 | 11/1969 | Fed. Rep. of Germany | 198/368 |
| 2006090 | 7/1978 | Fed. Rep. of Germany | 198/347 |
| 0566278 | 12/1923 | France | 198/525 |
| 2157252 | 10/1985 | United Kingdom | 131/283 |

*Primary Examiner*—H. Grant Skaggs
*Assistant Examiner*—Cheryl L. Gastineau
*Attorney, Agent, or Firm*—Antonelli, Terry, Stout & Kraus

[57] ABSTRACT

A stream of rod-like articles such as cigarettes in multi-layer stack formation is separated by a movable gate having a leading end capable of limited reversible movement in a direction generally transverse to the direction in which the gate is advanced, so as to facilitate advancement of the gate between articles of the stream. The gate may cooperate with a resilient closing strip in its closed position. Another form of gate comprises a pivoted plate biased into its closing position by a progressively increasing force.

11 Claims, 4 Drawing Sheets

APPARATUS FOR HANDLING ROD-LIKE ARTICLES

Figure 1:
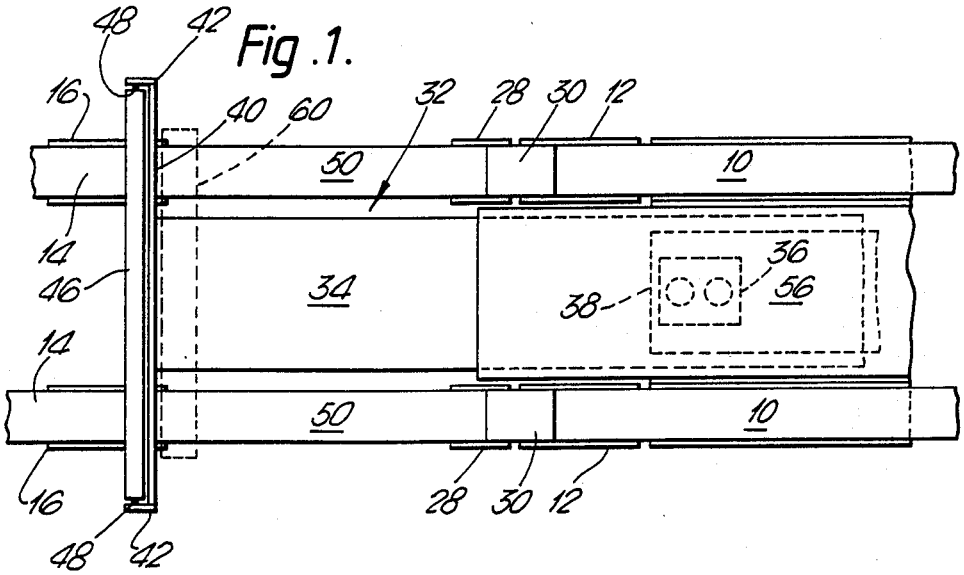

This is a division of application Ser. No. 721,414, filed Apr. 9, 1985, now U.S. Pat. No. 4,795,020.

This invention relates to apparatus for handling rod-like articles, particularly articles of the tobacco industry such as cigarettes or filter rods.

According to one aspect of the invention apparatus for handling rod-like articles comprises means defining a path for rod-like articles in multi-layer stack formation, a separating device movable relative to articles on said path, and means for advancing said device so as at least partly to separate a multi-layer stream on said path, said device having a leading part capable of reversible movement in a direction generally transverse to the direction in which the device is advanced, so as to facilitate advancement of the device between articles of said stream.

The device may comprise at least two relatively-movable parts, a first part comprising said leading part, and a second part for substantially separating articles of said stream. The second part may be rigid, e.g. a metal plate, in which case conveniently it may carry said leading part by means of a suitable mounting, e.g. a pin and slot arrangement, giving it a transverse freedom of movement. Alternatively, the second part may be flexible or semi-flexible, in which case said second part is conveniently maintained reasonably taut under tension, and may support said first part in a similar mounting.

The device may comprise substantially one part, so that the leading part is an integral portion of said one part. For example, the device may comprise a plate-like member mounted for advancement in a substantially longitudinal direction in such manner that transverse, e.g. pivotal, movement is possible. External means, e.g. a stationary cam, could control or limit transverse movement of the leading part (end) of the device.

The shape of the leading part is preferably adapted for insinuation between the rod-like articles, and preferably has a rounded end and may for example comprise a small diameter roller or a strip generally of aerofoil section.

The leading part may be free to move transversely according to the pressures to which it is subjected by the articles as it is advanced. In such case a total degree of transverse movement of 3–4 mm is normally sufficient when the articles have a diameter of 7–8 mm and the transverse width of the leading part is about 1 mm. The leading part may be subjected to imposed transverse movement as it is advanced. For example, an end portion of the part may be arranged to follow a stationary cam surface which provides a predetermined transverse movement for the leading part as it is advanced. Alternatively, or additionally, and particularly when the leading part is a roller, the part may be subjected to a rotational movement as it is advanced: this may additionally help to provide an easy path for said part between the articles of the stream.

The apparatus of the invention is particularly usefully employed as a closure device, where the separator device is advanced sufficiently far across the path that the path is effectively blocked. In this case the separator device normally approaches an opposed surface, and the degree of transverse movement available at the leading part alleviates the problem of pinching or trapping of an article against that surface, by normally allowing movement away of that article. Subsequent transverse movement of the leading part may prevent any further movement of articles between the element and said surface so that the path becomes blocked. The part of the opposed surface in the immediate vicinity of the closure device may be resilient or retractable to provide additional protection against trapping of an article against that surface.

The invention may be employed as a closure device at a T-junction between a substantially horizontal path and a substantially vertical path. The device may be used where a closure is required in any of the arrangements disclosed in British patent specification No. 2066761, or as a closure at the junction leading to the tray filler unit in any of the arrangements disclose din British patent specification No. 2142894, or in British patent application No. 8409096. The disclosure of said application is hereby incorporated herein in its entirety.

According to another aspect of the invention apparatus for handling rod-like articles, comprises means defining a path for rod-like articles in multi-layer stack formation, a separating device movable relative to articles on said path, and means for advancing said device from one side of said path towards the other side of said path so as substantially to separate a multi-layer stream on said path, wherein the device is arranged to co-operate with a resilient surface arranged at said other side of said path whereby articles are released from between said advancing device and said surface by movement of said surface away from said one side, said surface cooperating with said device normally to prevent articles passing between said surface and said device when said device is fully advanced across said path.

According to a further aspect of the invention apparatus for handling rod-like articles includes a generally horizontal first path for rod-like articles in multi-layer stack formation, a downwardly-extending second path for rod-like articles in multi-layer stack formation, a junction zone between said first and second paths, a pivoted closure member arranged adjacent said junction zone, means for biasing said closure member into a position to substantially block or inhibit passage of articles from said second path into said junction zone, and means for conveying articles along said second path towards said junction zone, the arrangement being such that when articles are conveyed along said second path said biasing means is overcome by pressure of articles conveyed along said second path so that said articles can move into said junction zone, and such that when articles are not conveyed along said second path said biasing means moves said closure member into said position thereby blocking or inhibiting passage of articles past said position to said junction zone.

Preferably said closure member and said biasing means are arranged so that the closure member is progressively retracted, so that the rate of passing of articles along the second path by driven conveying means may be progressively increased as the speed of the conveying means increases. The biasing means may be arranged to execute a progressively decreasing closing force on said closure member as said member is moved away from said position. The closure member may comprise a plate pivoted at an acute angle to said second path and biased downwardly by resilient means such as a spring or an adjustable weight. Preferably the junction zone includes sensor means arranged to control at least partly said conveying means. The closure member is effective to prevent articles from the second path being conveyed away on the first path at times other than when required, e.g. when the conveying means (i.e. for articles on said second path) is inoperative.

Figure 2:
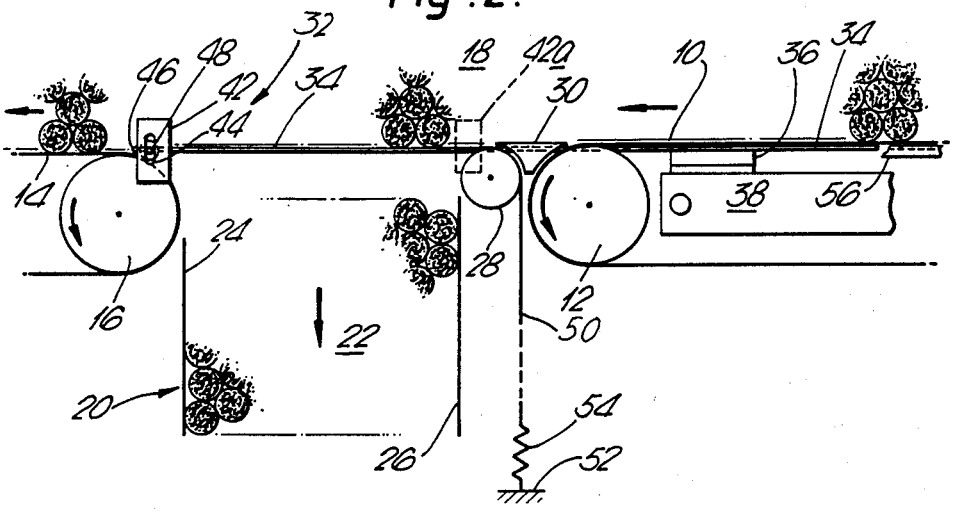
Figure 3:
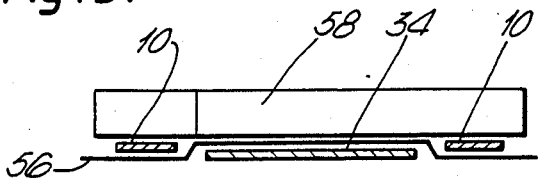
Figure 4:
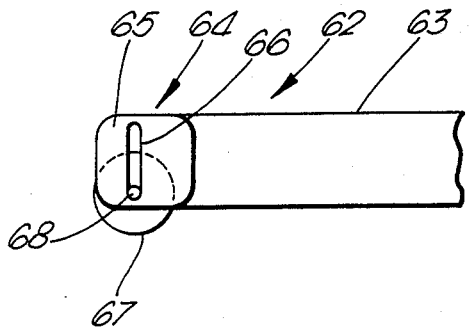
Figure 10:
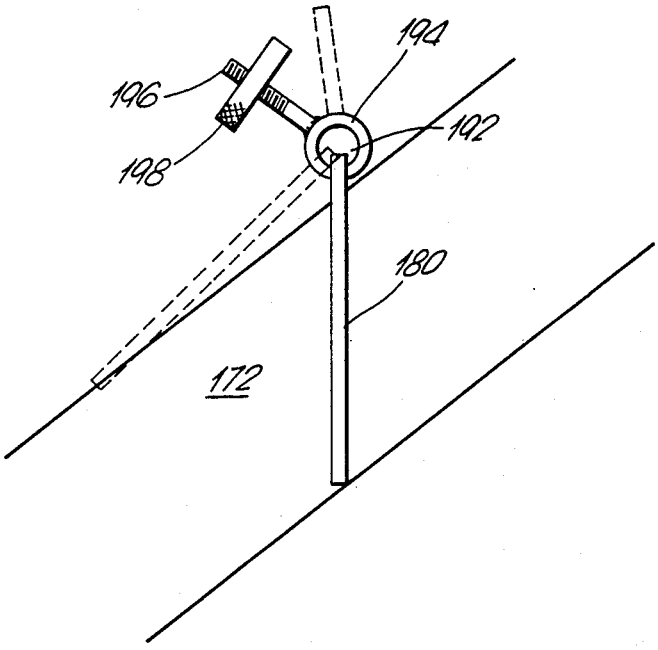
Figure 5:
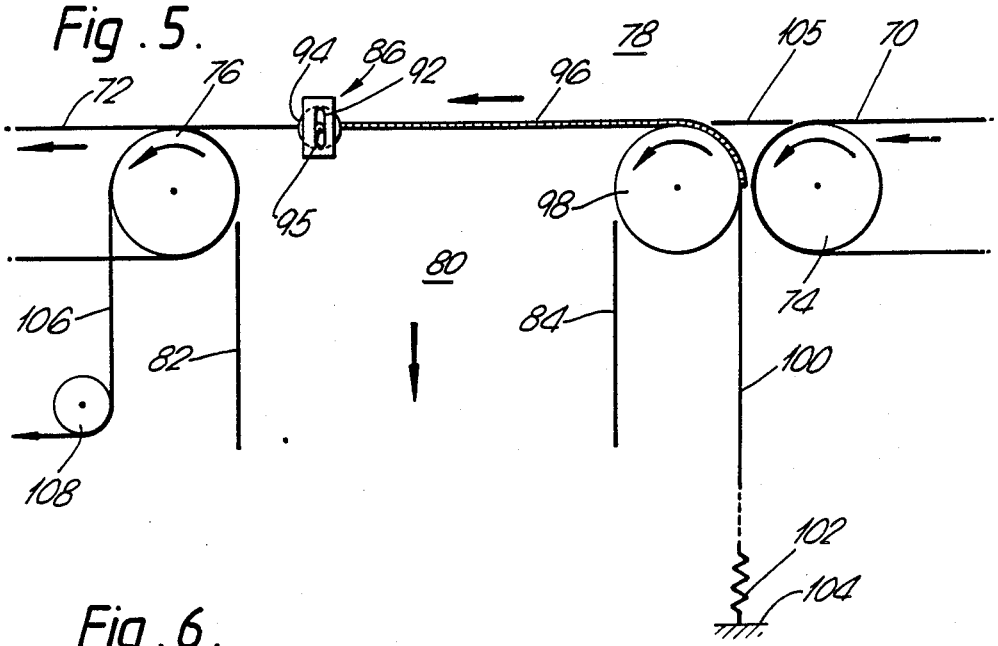
Figure 6:
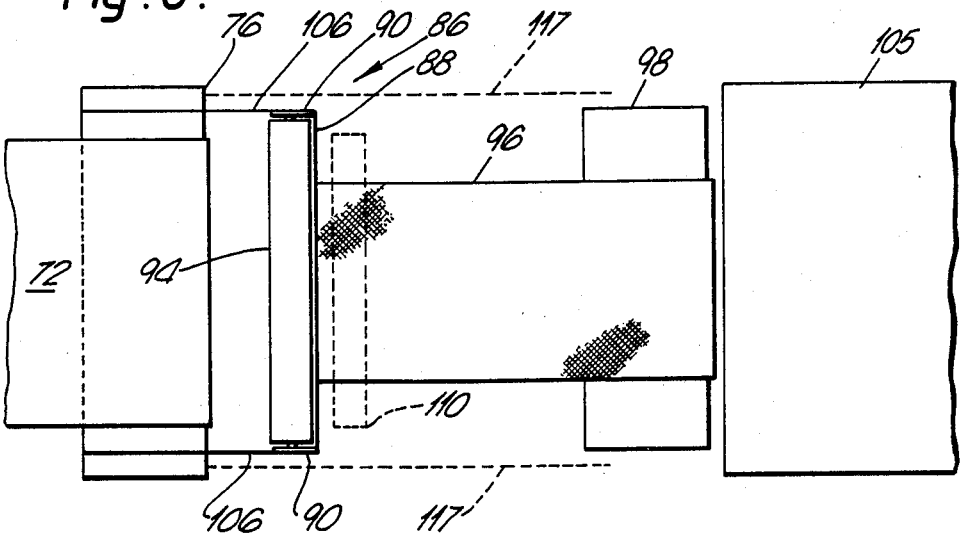
Figure 7:
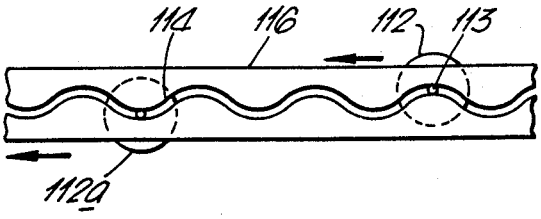
Figure 8:
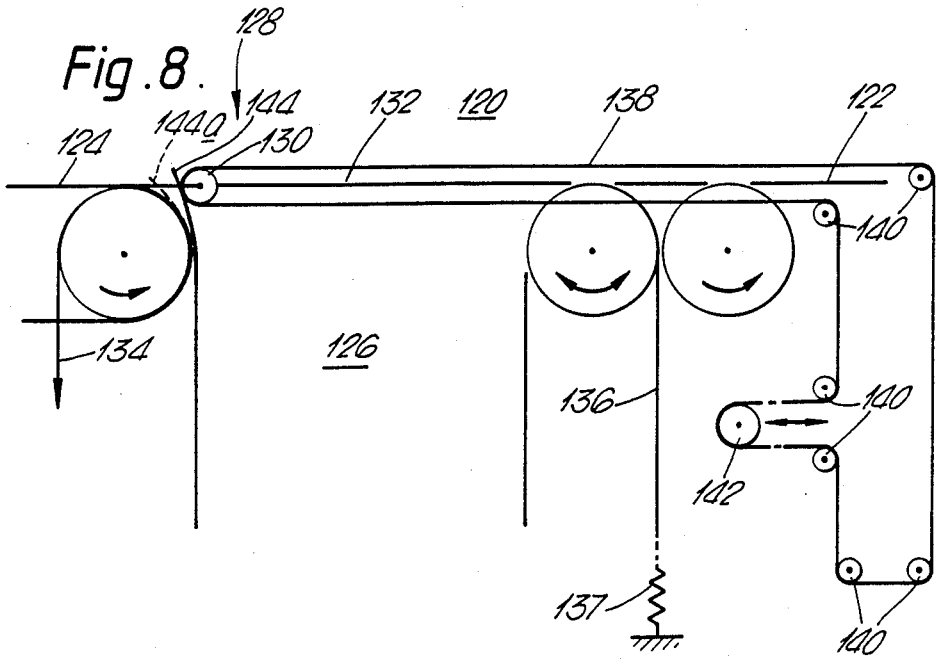
Figure 9:
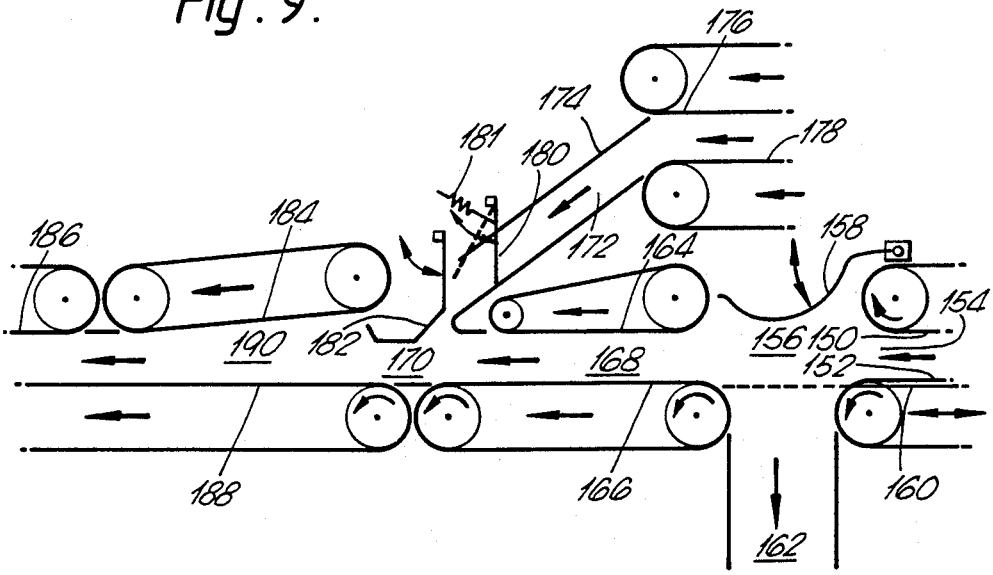

The invention will be further described, by way of example only, with reference to the accompanying diagrammatic drawings (which are not to scale), in which:

FIG. 1 is a plan view of a conveyor arrangement for cigarettes, which incorporates a closure device, FIG. 2 is a side view of the convey arrangement of FIG. 1, FIG. 3 is a transverse sectional view of part of the conveyor arrangement of FIG. 1, FIG. 4 is an enlarged side view of a modified closure device, FIG. 5 is a side view of another conveyor arrangement incorporating a closure device, FIG. 6 is a plan view of the conveyor arrangement of FIG. 5, FIG. 7 is a side view of part of a modified conveyor arrangement, FIG. 8 is a side view of a further conveyor arrangement incorporating a closure device, FIG. 9 is a side view of a still further conveyor arrangement incorporating closure devices, and FIG. 10 shows a modified closure device for use in the arrangement of FIG. 9.

FIGS. 1 and 2 show a conveyor arrangement for cigarettes or similar rod-like articles in multi-layer stack formation and comprising a first pair of transversely spaced endless bands 10 passing around end rollers 12 and a second pair of transversely spaced endless bands 14 passing around end rollers 16. The bands 10 nd 14 support a stream 18 of cigarettes extending in a substantially horizontal direction. The rollers 12 and 16 are horizontally spaced and a substantially vertical path or chute 20 extends downwardly between them and contains a stream 22 of cigarettes. The sides of the chute 20 are defined by walls 24, 26. The wall 26 is horizontally spaced from the rollers 12 and extends from a position adjacent a further pair of transversely spaced rollers 28. A pair of transversely spaced dead-plates 30 extends between the rollers 12 and 28, to support the stream 18. Typically the stream 18 may be 90–100 mm high and the stream 22 may be about 120 mm wide.

A closure device 32 comprising a metal plate 34 is directly attached by a bracket 36 to the piston of a rodless air cylinder 38 which is located between and below the bands 10. The end of the plate 34 remote from the cylinder 38 carries a yoke 40 having side plates or flanges 42 provided with vertically extending slots 44. A leading edge element 46 in the form of a thin narrow strip carries outwardly extending pins 48 which are captive and movable in the slots 44. Two flexible bands 50 are connected to the yoke 40 on each side of the plate 34 and extend parallel to the plate as far as the rollers 28. The bands 50 pass partially around the rollers 28 and are connected to a fixed surface 52 by means of restoring springs 54.

Upstream of the rollers 12 the bands 10 are partly supported and the plate 34 is shielded from interference with cigarettes on the stream 18 by a stationary thin metal plate 56. This is shown more clearly in FIG. 3, which also shows a cigarette 58 of the stream 18. For clarity only the extreme right-hand portion of the plate 56 is shown in FIG. 2. As shown by FIG. 1, the left-hand end of the plate 56 extends between the rollers 12 and dead-plates 30 to shield the moving plate 34 up to the rollers 28.

In operation, when it is required to close the upper end of the path 20, so that cigarettes are unable to pass into it from the stream 18, and so that articles in the stream 18 and/or those in the stream 22 are not subjected to rubbing or other condition causing degradation when it is required to move the stream 18 and keep the stream 22 stationary, the closure device 32 is advanced by action of the cylinder 38 from a retracted position (indicated in dotted lines at 42*a* in FIG. 2) to the position shown in full lines in FIG. 2. The plate 34 is relatively rigid and typically consists of steel approximately 1 mm in thickness and is well supported by the cylinder 38 so that no additional guides for its movement across the path 20 are required.

The leading edge element 46 of the device 32 has a rounded or tapered end and may be similar to an aerofoil. Typically the thickness of the element 46 is about the same as that of the plate 34 (i.e. 1 mm). The slots 44 may be of such length that the pins 48 may move by about 3–4 mm so that the element 46 may move by about this amount during its movement across the path 20. The vertical freedom of movement thus available for the element 46 is sufficient to allow it to take the "path of least resistance " between cigarettes extending between the streams 18 and 22, thereby facilitating its advancement and also minimising possible damage to the cigarettes. In particular, as the element 46 approaches the rollers 16 any cigarettes momentarily located between the advancing element and the rollers is readily removed by the movement of the bands 14 around the rollers since the element normally has sufficient upward freedom of movement to release the cigarettes. Subsequently the element 46 tends to fail somewhat, preventing any further cigarettes becoming trapped between it and the rollers 16. It should be noted that the closure device 32 is advanced in a generally horizontal direction at or slightly below the level of the bands 10, and that the bands 14 are at a slightly lower level than the leading edge element 46 of the device 32 in its extended position.

As shown in FIG. 1 the side flanges 42 are beyond the ends of the cigarettes in the stream 18; a cigarette is indicated at 60. The part of the yoke 40 between the flanges 42 is no thicker than the leading edge element 46 or plate 34. Although the element 46 may be misaligned relative to the plate 34 by a few millimeters during its passage across the path 20 this causes no significant disturbance of the cigarettes, and the plate 34 is readily able to follow the advancing element 46 without causing damage. Although the plate 34 is capable of supporting the cigarettes in the stream 18 above the path 20, additional support, particularly for long cigarettes, is provided in the form of the bands 50 which are withdrawn around the rollers 28 during advancement of the device 32. A pair of springs 54 maintains the bands 50 taut and ensures their retraction when the closure device 32 is itself retracted. The bands 50 are not essential and may be omitted. In order to minimise disturbance of the stream 18 the device 32 may be advanced at substantially the same speed as the speed of conveyance of the stream by the bands 10 and 14. The device 32 may be advanced at a different speed, however, and may be advanced where neither stream 18 or stream 22 is moving.

FIG. 4 shows the leading end of a modified closure device 62. This comprises a plate 63, a yoke 64 having side flanges 65 with slots 66, and a roller 67 having pins 68 extending into the slots. The thickness of the plate 63, the height of the flanges 65 and the diameter of the roller 67 are all about 3–4 mm. The height of the slots 66 is about 3 mm. Since the flanges 65 are about the same height as the thickness of the plate 63 they need not be axially outside the region of the cigarettes. This is true even where the height of the flanges 65 is greater than the thickness of the plate 63; preferably the upper edges of the flanges and yoke 64 are at about the same level as the upper surface of the plate. Operation of the closure device 62 and construction of associated parts is substantially as described with reference to FIGS. 1–3.

The conveyor arrangement shown in FIGS. 5 and 6 comprises first and second endless bands 70, 72 (which may comprise transversely-spaced bands similar to the bands 10, 14 in the arrangement of FIG. 1), passing around rollers 74, 76 respectively, and defining a horizontal path 78 for cigarettes in stack formation. Between the rollers 74, 76 a vertical path 80 is defined by substantially vertical walls 82, 84. A retractable closure device 86 is arranged to span the path 80 and comprises a yoke 88 having side flanges 90 provided with vertical slots 92 in a similar manner to the yoke 40 and side flanges 42 of the arrangement of FIG. 1. A leading edge element 94 in the form of a roller having axially extending spindles 95 is mounted for limited vertical movement in the slots 92 between the side flanges 90. Extending rearwardly from the yoke 88 is a flexible element 96, preferably comprising TISS-metal or a low friction plastics material. The flexible element 96 passes partly around a further roller 98 positioned just downstream of the roller 74 and is attached by wires 100 to tension springs 102 connected to a fixed surface 104. A deadplate 105 is arranged to support the stream 78 between the rollers 74 and 98. The side flanges 90 are connected to draw wires 106 which pass over the roller 76 to a pulley 108 or similar means for advancing the device 86.

The operation of the device 86 is substantially similar to that of the device 32. The pulley 108 is operated to draw the wires 106, and hence the yoke 88 and flexible element 96, from a retracted position (in which the yoke 88 is adjacent the roller 98) against the action of the tension springs 102. In certain circumstances the rotation of the roller 76 may be sufficient to draw the wires 106 by friction. In this case operation of the device 86 may be controlled by releasing the wires 100 to allow closing of the path 80 by the device 86, and by drawing on the wires 100 to retract the device. Note from the cigarette indicated at 110 in FIG. 6 that the wires 106 and side flanges 90 do not interfere with the cigarettes on the path 78. The roller 94 performs a similar function to the element 46 in the arrangement of FIG. 1, and is substantially interchangeable with it, so that the roller 94 could replace the element 46 and vice versa.

As shown in FIG. 7, instead of allowing limited free vertical movement of the element 46, 67 or 94, a leading edge element 112 could have pins 113 which extend (e.g. through side flanges similar to the flanges 42, 65 or 90) into slots 114 in stationary side plates 116. These may be provided just to the outside of the paths of the side flanges 42 or 90, i.e. in positions corresponding to the dotted lines 117 shown in FIG. 6. The slots 114 could then be provided with a suitable undulating shape to provide a form of cam which, as the element 112 advances, causes the element to rise and fall vertically so that the cigarettes are gently dislodged to make a path for the element and its following plate or other closure element. The vertical displacement between the element 112, which is in its uppermost position as shown in FIG. 7, and that of the element when it is in its lowermost position, indicated at **112*a* is about 3–4 mm. By providing suitable rolling friction engagement between the pins 113 and the slots 114 the roller 112** could be caused to rotate during advancement (and retraction). This may additionally aid its operation.

FIG. 8 shows a further conveyor arrangement which is rather similar to that of FIGS. 5 and 6. A horizontal path 120 for cigarettes in stack formation is defined by bands 122 and 124. A vertical path 126 extends downwards between the bands 122 and 124, and a closure device 128 having a leading roller 130 and a trailing flexible closure element 132 is extendable across the path 126. The device 128 may be advanced by draw wires 134 and retracted by wires 136 attached to a spring 137. The roller 130, which may be mounted for vertical movement in the same manner as the roller 67 or 94, may be rotated, as an additional aid to advancement between cigarettes, by means of a drive band 138 which passes around the roller 130 and also around additional rollers 140, at least on of which imparts drive to the band, and a tensioning roller 142. Preferably the band 138 is driven so that it imparts a clockwise rotary movement to the roller 130 as viewed in the drawing: this will tend to help clear cigarettes from the vicinity of the band 124 when the device 128 is almost closed. The drive to the band 138 may be reversible, however, and the roller 130 could be rotationally oscillated as the device 128 is advanced. The band 138 is transversely outside the line of cigarettes on the path 120, so that it does not interfere with their movement. A pair of drive bands 138 could be provided, one on each side of the roller 130.

The arrangement of FIG. 8 includes an additional measure to help prevent damage to cigarettes as the closure device 128 reaches its closed position. This comprises a semi-flexible resilient strip 144 (e.g. of MELInEX or spring steel) which naturally will assume the position indicated in the drawing but which may be displaced by relatively light pressure, such as may be imposed by a cigarette being pushed by the advancing roller 130, into the position **144*a*. Subsequently, on removal of the cigarette, e.g. by the action of rotation of roller 130, the strip 144 will spring into the position shown by the full line and effectively prevent any further cigarettes from falling into the gap between the roller 130 and the band 124. A strip similar to the strip 144 could be used in the arrangements of FIGS. 1–3, 4, 5–6, or 7**.

FIG. 9 shows a conveyor arrangement comprising upper and lower band conveyors 150, 152 for conveying a multi-layer stream 154 from a delivery device (e.g. a cigarette making machine) to a junction 156 with a path 162 which extends downwardly (e.g. to a tray filling unit). A sensor 158 and a closure device 160, which may take the form of any of the closure devices shown in FIGS. 1–8, are arranged adjacent the junction 156. Downstream of the junction 156 upper and lower band conveyors 164, 166, convey a stream 168 to a further junction 170, at which a stream 172 from an inclined path 174 is merged with the stream 168. The stream 172 is delivered from upper and lower band conveyors 176, 178, extending for example from a tray unloader unit. The path 174 is closable by a pivoted plate 180 which is lightly biased into its closed position by a compression spring 181. A pivoted sensor 182 is arranged above the junction 170. Downstream of the junction 170 upper band conveyors 184, 186 and a lower band conveyor 188 convey a stream 190 towards a receiving device (e.g. a cigarette packing machine).

The plate 180 is lightly biased into the position shown in the drawing by the spring 181. At times when the conveyors 176, 178 are not delivering cigarettes into the path 174 the pressure of the spring 181 is sufficient to gently close off the path and maintain the cigarettes in the stream 172 upstream of the plate 180. Any cigarettes downstream of the plate 180 when the plate is closing or shortly after the plate has closed with trickle into the junction 170 and are conveyed away with the stream 190. When the conveyors 176, 178 are restarted the pressure which is thereby imparted to the cigarettes in stream 172 is sufficient to overcome the light pressure of spring 181 so that the plate 180 is progressively pivoted into the position shown in dotted lines in the drawing, gradually allowing an increased stream 172 through to the junction 170. In this mode the sensor 182 at least partly controls the speed of the conveyors 176, 178. Similarly when the stream 162 is moving the sensor 158 at least partly controls the rate of acceptance of the stream (e.g. it controls the speed of a tray filling unit).

An alternative arrangement to the use of a spring 181 is shown in FIG. 10. The plate 180 is pivotally mounted on a spindle 192. A collar 194 carrying a threaded shaft 196 clamped on the spindle 192 so that the angle between the plate 180 and shaft 196 may be adjusted. A weight 198 is in threaded engagement with the shaft.

The angle between the plate 180 and shaft 196 is adjusted so that there is a light but definite closing torque applied to the plate when it is in the fully closed position (shown in full lines in FIG. 10). The closing torque applied becomes progessively less as the plate 180 is moved clockwise towards its open position, and in its fully open position (shown in dotted lines in FIG. 10) there is a very small closing force applied so that very little impedance is offered to cigarettes flowing on the path 172. The position of the weight 198 on the threaded shaft 196 may be adjusted to provide additional adjustment of the closing torque.

We claim:

1. Apparatus for handling rod-like articles, comprising a generally horizontal first path for rod-like articles in a multi-layer stack formation, a downwardly extending second path for rod-like articles in multi-layer stack formation, a junction zone between said first and second paths, a pivoted closure member arranged adjacent the junction zone, means for biasing the closure member into a position to substantially block or inhibit passage of articles from said second path into said junction zone, and means for conveying articles along said second path towards said junction zone; the arrangement being such that when articles are conveyed along said second path said biasing means is overcome by pressure of articles so that said articles can move into said junction zone, and such that when articles are not conveyed along said second path said biasing means moves said closure member into said position thereby blocking or inhibiting passage of articles past said position to said junction zone, wherein the biasing means is arranged to exert a progressively decreasing closing force on said closure member as said member moves away from said position.

2. Apparatus as claimed in claim 1, wherein said conveying means comprises driven means for conveying articles along at least part of said second path, and wherein the closure member and biasing means are arranged such that the closure member progressively moves away from said position to allow a progressively increasing rate of conveyance of articles along the second path as the speed of said driven means is progressively increased.

3. Apparatus as claimed in claim 1, wherein the closure member comprises a plate pivoted about an axis so that it forms an acute angle with said second path when in said position.

4. Apparatus as claimed in claim 3, wherein said biasing means comprises resilient means.

5. Apparatus as claimed in claim 3, wherein said biasing means comprises a weight arranged to partially counterbalance said plate.

6. Apparatus as claimed in claim 5, wherein said weight and plate extend in different angularly spaced directions relative to said axis.

7. Apparatus as claimed in claim 6, including connection means for said weight and plate, said connection means including means for fixedly securing said weight and plate in different relative angular positions relative to said axis.

8. Apparatus as claimed in claim 5, including means for supporting said weight at different distances from said axis.

9. Apparatus as claimed in claim 1, wherein the junction zone includes sensor means arranged to control at least partly the conveying means.

10. Apparatus as claimed in claim 1, including means for conveying articles on said first path, which means is independent of said conveying means for articles on said second path, said biasing means being arranged to move said closure member into said position to prevent articles passing from said second to said first path when said means for conveying articles on said first path is operating but said means for conveying articles on said second path is not operating.

11. Apparatus for handling rod-like articles, comprising a generally horizontal first path for rod-like articles in a multi-layer stack formation, a stationary channel forming a downwardly extending second path for rod-like articles in multi-layer stack formation, a junction zone between said first and second paths through which articles on said second path pass and merge with articles carried on said first path, said second path forming an acute angle with said horizontal first path so that said paths converge in the direction of article conveyance at said junction zone, a pivoted closure member arranged in said second path upstream of the junction zone, means for biasing the closure member into a position in which it extends generally transversely across a downwardly extending portion of said second path to substantially block or inhibit passage of articles from said second path into said junction zone, and means for conveying articles along said second path towards said junction zone, the arrangement being such that, when articles are conveyed along said second path, said biasing means is overcome by pressure of articles so that said articles can move into said junction zone and are deposited on articles being converged on said first path, and such that, when articles are not conveyed along said second path, said biasing means moves said closure member into said position thereby blocking or inhibiting passage of articles past said position to said junction zone.

* * * * *